United States Patent [19]

Balchunas

[11] 4,101,729

[45] Jul. 18, 1978

[54] APPLIANCE STRAIN RELIEF

[75] Inventor: Charles A. Balchunas, Alta Loma, Calif.

[73] Assignee: General Electric Company, Bridgeport, Conn.

[21] Appl. No.: 765,664

[22] Filed: Feb. 4, 1977

[51] Int. Cl.[2] ..... H01R 13/58; D06F 75/28

[52] U.S. Cl. ..... 174/65 R; 38/88; 38/90; 174/135; 339/107

[58] Field of Search ..... 174/46, 65 R, 65 G, 174/135, 153 G; 219/256; 339/58, 101, 103 R, 103 B, 103 C, 105, 107; 38/88, 90

[56] References Cited

U.S. PATENT DOCUMENTS

| | | | |
|---|---|---|---|
| 2,308,515 | 1/1943 | Kistner | 219/256 |
| 3,665,374 | 5/1972 | Denton | 339/101 |
| 3,858,160 | 12/1974 | Denton | 339/101 X |
| 4,056,252 | 11/1977 | Simon | 339/103 B X |

FOREIGN PATENT DOCUMENTS

| | | | |
|---|---|---|---|
| 2,315,409 | 10/1974 | Fed. Rep. of Germany | 174/135 |
| 2,336,612 | 1/1975 | Fed. Rep. of Germany | 174/135 |
| 170,982 | 4/1960 | Sweden | 339/107 |

*Primary Examiner*—Laramie E. Askin

*Attorney, Agent, or Firm*—John F. Cullen; George R. Powers; Leonard J. Platt

[57] ABSTRACT

For use in a portable electric appliance, that is cord-connected to internal electric terminals by multiple conductors, there is provided a strain relief assembly between the cord and appliance that has a housing chamber in the appliance at the cord entrance. A formed saddle is secured to the chamber and has spaced ears defining a preferably slanted passage therebetween aligned with the lay of the cord and which holds the cord conductors as the cord enters the appliance. There is provided a formed clamp fitting over the saddle and removably attached thereto. The clamp has a toothed flexible strap-like extension in a generally U-shape connected at one end of the clamp and freely hanging at the other end with downward opening teeth at the free end which are disposed into the passage against the conductors to jam them in the passage. A wedge means is provided on the clamp opposite the extension and a cover is over the entire strain relief assembly so that the flexible extension is forced by the wedge into biting engagement with the conductors in the passage, the wedge and free flexible extension permitting the strain relief to be used with different sized conductors.

7 Claims, 3 Drawing Figures

APPLIANCE STRAIN RELIEF

BACKGROUND OF THE INVENTION

1. Field of the Invention

The invention relates to a strain relief assembly for an electric appliance, the various parts being molded plastic and performing multiple functions and being flexible to accept different sizes or numbers of conductors.

2. Description of the Prior Art

Many portable cord connected electric appliances have stringent safety requirements. Generally, the requirements are such that the appliance should be supportable by the cord alone without putting undue strain on the internal electrical connections for the conductors within the cord. It is undesirable to transmit stress through the cord to the appliance terminals for obvious reasons and it is common to provide various forms of strain relief such as knots, clamps, or various plates to permit slack in the conductors in the appliance to thus relieve stress on the terminals. Also, different parameters must be met to qualify for Underwriters' Laboratory, Inc. approval. Similarly, there are various foreign equivalents to UL that have their own requirements in order for the appliance to be acceptable. Various cords which are made of many differing materials for different requirements depending on the appliance, and a typical appliance subjecting a cord to stringent conditions is the electric flatiron and it is to this that the invention is directed for purposes of description although it is not so limited. A late development of cord used on irons is heater parallel neoprene or HPN cord of an improved version that comprises chlorosulphonated polyethylene which has a tough coating and is temperature resistant. Such a cord-connecting structure is described in U.S. Pat. No. 3,665,374 of common assignment and which is directed to a means to prevent breaking of the fine wires within the conductors when the entire conductor is the above material. In some cases the conductors may be separate elastomeric such as rubber covered within a sheath of the above material which is desirable in flatirons because it slides easily over the material and does not leave marks on the cloth. In a flatiron, like other appliances, it is customary to provide a point where the cord is tightly compressed between two parts, generally in the iron handle. Usually the conductors are attached to the internal terminals and laid against the handle and held by a cover with a sharp-edged tongue that presses or "bites" into the cord to jam it as the cover is tightened into the handle housing. This squeezing of the cord between the parts relieves the terminals of stress applied by the cord and is shown at 28 in U.S. Pat. No. 3,858,160. Other forms of stress relief use clamps 39 as in U.S. Pat. No. 2,727,322 or a strain relief plate 74 as in U.S. Pat. No. 2,602,248 all of common assignment. Additionally, in foreign applications, it is desirable to provide a strain relief that is flexible and automatically adjustable to be used with different-sized conductors that are required in some countries.

SUMMARY OF THE INVENTION

Briefly described, the invention is directed to a strain relief assembly that is used in a portable electric appliance wherein multiple conductors are connected to internal electric terminals. The strain relief assembly comprises a housing chamber in the appliance at the cord entrance and a separate formed saddle is secured to the chamber and has spaced ears to define a passage therebetween, the passage being aligned with the lay of the cord as it enters the appliance to contain the cord conductors. The cord and its conductors are held by a formed clamp that fits over the saddle and is removably attached thereto with the clamp having a toothed flexible extension in the form of a U-shaped strap or loop secured to the clamp at one end and having downwardly opening teeth at the other end which are disposed into the passage to jam the conductors therein. The passage may also be slanted against the teeth to tighten the jamming action between the clamp and saddle. A wedge is provided on the clamp opposite the extension and a cover over the clamp and saddle is provided so the flexible extension is forced by the wedge into biting engagement with the conductors as the teeth move only along the wedge surface on contact therebetween so that the strain relief may be used with different size conductors and automatically aligns itself into proper strain relief position.

DESCRIPTION OF THE PREFERRED EMBODIMENT

While the invention is applicable to any cord-connected appliance regardless of the material or appliance used, it is specifically applicable to an electric flatiron and, for convenience, will be described in connection therewith. It is also applicable to the three-conductor cords using a ground conductor as shown and preferred or it is applicable to the more common dual conductor cord.

Figure 1:
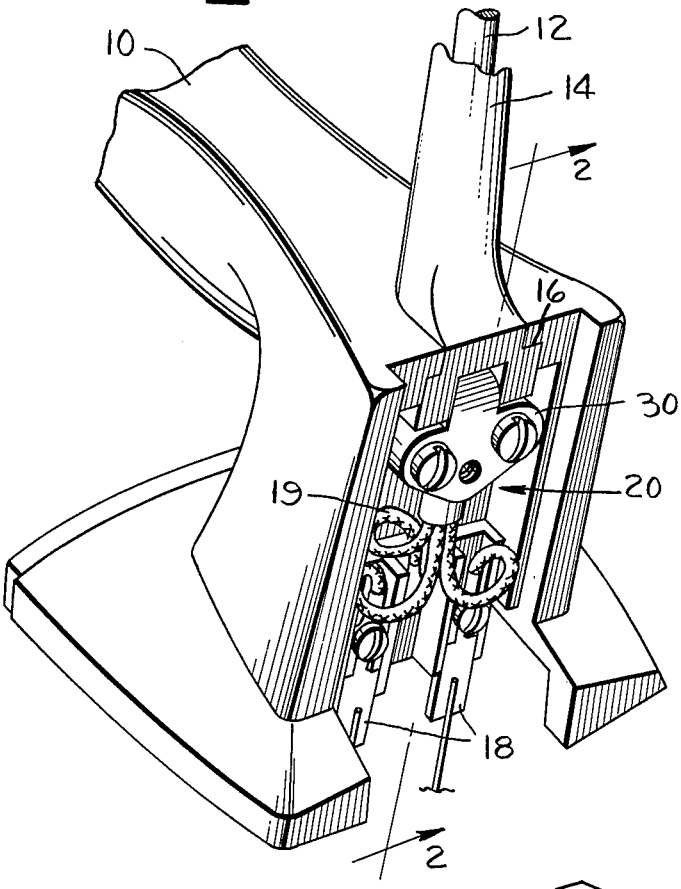
FIG. 1 is a partial perspective of the heel portion of an iron handle where the strain relief is located.
Figure 2:
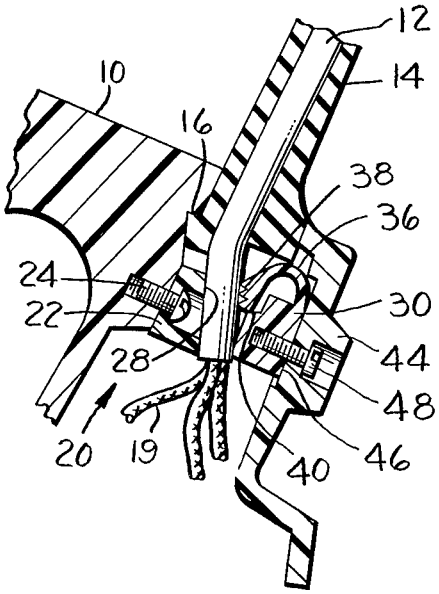
FIG. 2 is a partial cross-sectional view on line 2—2 of FIG. 1 showing the assembled position.

Referring first to FIGS. 1 and 2, there is shown an electric flatiron handle 10 from which the usual cord 12 extends protected by elongated flexible sleeve 14 surrounding the cord and anchored to the appliance by formed lip 16 in a well-known manner. The cord extends out of the top of the handle at the rear for convenient use by a right or lefthanded operator although it can extend from the sides in a well-known manner and the invention is applicable to any such connection. After entering the handle, the cord has a portion generally separated into plural conductors with the individual conductors connected to terminals 18 to supply power to the iron with one of the conductors 19 being attached to a suitable grounding terminal in a standard terminal block in the iron. Some stress relief assemblies have used suitable clamps or plates or just a plain toothed tongue to hold the conductors 12 against longitudinal movement or the tongue may automatically position the conductors in proper strain relief as they lie inside the handle housing as shown in U.S. Pat. Nos. 2,727,322, 2,602,248, 3,665,374, and 3,858,160.

Figure 3:
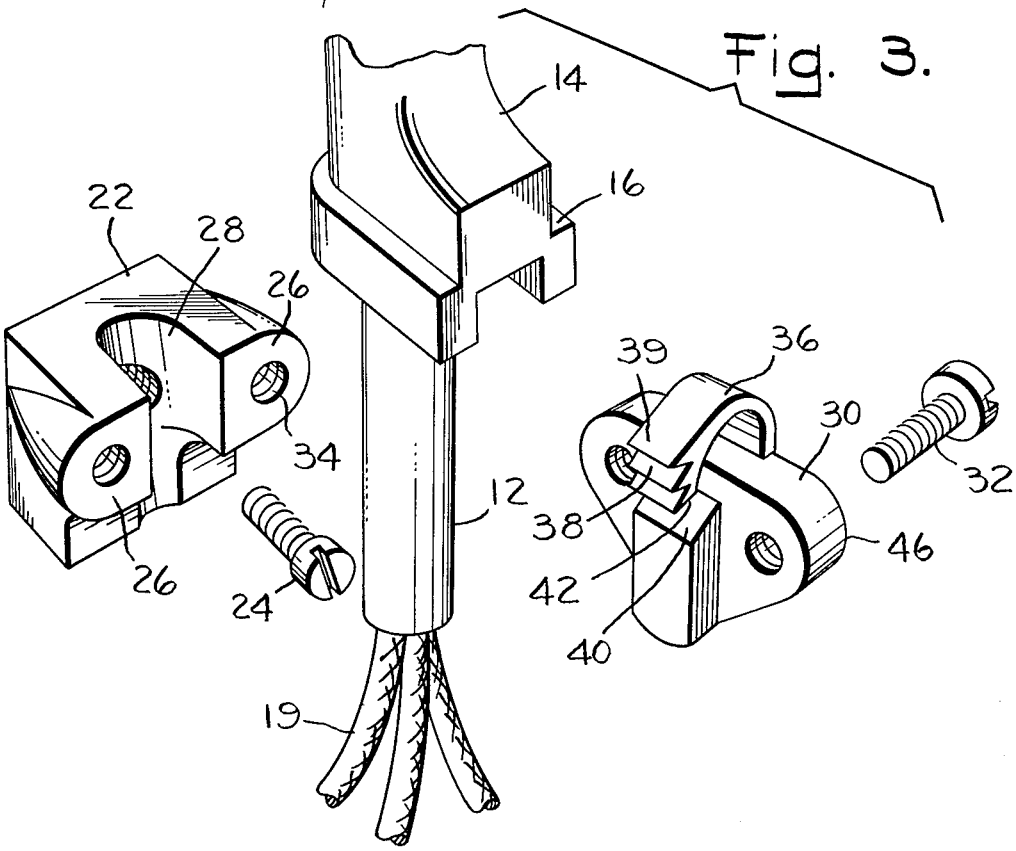
FIG. 3 is an exploded view of the parts of FIG. 2 of the strain relief assembly.

In order to position the conductors by a strain relief assembly that is usable with different sized conductors, there is provided, as seen in FIGS. 1 and 2, a housing chamber in the appliance generally indicated at 20 and located at the cord entrance as seen in FIG. 2. For containing the cord and conductors in the chamber, a formed saddle 22 of a non-conducting material, such as plastic, is provided and is secured to the chamber by suitable means such as recessed screw 24 to lock it in place. To align the cord and its contained conductors, the saddle has spaced ears 26 as seen in FIG. 3 which define a passage 28 therebetween and the passage is aligned with the lay or direction of the incoming cord so the cord lies in this passage or trough 28 as seen in FIG. 2. For better anchoring, as explained later, the passage 28 may be slanted to increase in height from top to bottom as seen in FIGS. 2 and 3.

In some foreign applications, the size of the individual conductors may vary within, for example, a range of approximately one conductor thicker or thinner than the three conductors shown. To accommodate this variance in a standard strain relief assembly, there is provided a particularly formed clamp 30 that fits over the saddle 22 and is removably attached to it by screws 32 received in holes 34 in the ears. For flexibility and self and automatic adjustment for differing sized conductors, clamp 30 is also of non-conducting and preferably plastic material and is provided with a flexible strap 36 connected at one end to the clamp with the other end free and hanging in a U-shaped loop in a flexible extension 39 as shown in FIG. 3. The free end is provided with a gripping portion in the form of downward opening teeth 38 at the end of the extension or loop to jam the individual conductors toward the appliance as seen in FIG. 2. Because the loop hangs free in a general biasing direction against the conductors, it is free to move back and forth to adjust for different sized conductors and is of a width sufficient to be disposed or fit into the passage 28 to bite against the conductors as shown in FIG. 2. For applying a force against the teeth 38 under different locking conditions, the clamp 30 is provided with a wedge 40 disposed opposite the extension 39 carrying the teeth 38. The relation between wedge 40; and extension 39 is such that, under all conditions of operation, on tightening of screws 32 to secure the clamp to the saddle, the corner 42 of the extension always falls on the surface of wedge 40. In other words, the extension is neither too short nor too long so that it is always disposed adjacent the wedge for movement only along the wedge surface on contact between corner 42 and the wedge. This permits biting and wedging the teeth into different size conductors for the flexibility necessary under different conditions. The jamming action toward the appliance is enhanced, as seen in FIG. 2, by cooperation between downward teeth 38 and the slanting of passage 28 since each then works against the other to squeeze the cord 12 therebetween.

The open housing 20 is closed by a suitable cover 44 and this preferably bears on a surface 46 on the clamp opposite the wedge 40 for locating and securing the cover to the clamp by a screw 48 under all sized conductors used. This ensures that the cover 44 is properly secured regardless of the thickness of the cord 12 or the position of the strap 36 since the cover may be secured directly to the clamp surface and not the iron handle.

Thus, the strain relief assembly with its flexible strap construction with the bend or U-loop permits the teeth to secure the cord in a plurality of cord sizes and is therefore self-adjusting. The corner 42 is designed to always operate along the wedge 40 to drive it in against the cord by a wedging action and the downward opening teeth 38 prevent any slipping upwardly. The use of the slanted passage 28 against the operation of the teeth 38 merely provides for increasing the jamming action between the two when the clamp 30 is tightened to saddle 22. Therefore, there is provided a self-adjusting and flexible strain relief assembly that is adaptable to cords of different sized conductors permitting the same strain relief assembly to be used under different requirements.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a portable electric appliance cord-connected to internal electric terminals by multiple conductors, the improvement in a strain relief assembly between the cord and appliance comprising, a housing chamber in the appliance at the cord entrance, a formed saddle secured to the chamber and having spaced ears defining a passage therebetween aligned with the lay of the cord to contain the cord conductors, a formed clamp fitting over said saddle and removably attached thereto, said clamp having a toothed flexible extension disposed into said passage against the conductors therein, a wedge means on said clamp opposite said extension, and a cover over said clamp and saddle, whereby said flexible extension is forced by said wedge means into biting engagement with said conductors in said passage permitting said strain relief assembly to be used with different-sized conductors.

2. Apparatus as described in claim 1 wherein said flexible extension is biased against the conductors.

3. Apparatus as described in claim 2 wherein said extension is a U-shaped loop having downward-opening teeth at one end to jam said conductors toward said appliance.

4. Apparatus as described in claim 3 wherein said saddle passage is slanted against said teeth to tighten the jamming action therebetween on tightening said clamp to said saddle.

5. Apparatus as described in claim 3 wherein said loop is a flexible strap connected at one end to the clamp with the other toothed end free and diposed adjacent said wedge for movement only along the wedge surface on contact therebetween.

6. Apparatus as described in claim 5 wherein said saddle passage is slanted against said teeth to tighten the jamming action therebetween on tightening said clamp to said saddle.

7. Apparatus as described in claim 5 wherein the clamp has a surface opposite said wedge for locating and securing said cover under all sized conductors used.

* * * * *